United States Patent [19]

Laakso

[11] 4,347,678

[45] Sep. 7, 1982

[54] MULTI-SIDED DISPLAY DEVICE

[75] Inventor: John K. Laakso, West Bloomfield, Mich.

[73] Assignee: Marketing Displays, Inc., Farmington Hills, Mich.

[21] Appl. No.: 225,318

[22] Filed: Jan. 15, 1981

[51] Int. Cl.[3] ..... G09F 15/00

[52] U.S. Cl. ..... 40/607

[58] Field of Search ..... 40/606, 607, 605; 248/218.4, 219.1, 228; 211/107

[56] References Cited

U.S. PATENT DOCUMENTS

| | | | |
|---|---|---|---|
| 2,616,196 | 11/1952 | Sandahl | 40/607 |
| 2,625,762 | 1/1953 | McColl | 40/607 |
| 2,772,494 | 12/1956 | Bishop | 40/605 |

FOREIGN PATENT DOCUMENTS

| | | | |
|---|---|---|---|
| 652427 | 11/1962 | Canada | 40/607 |
| 619085 | 12/1926 | France | 40/607 |

*Primary Examiner*—Gene Mancene
*Assistant Examiner*—Wenceslao J. Contreras
*Attorney, Agent, or Firm*—Harness, Dickey & Pierce

[57] ABSTRACT

A multi-sided display device for mounting a plurality of sign panels on a pole is disclosed. The device is adaptable for all sizes and types of poles and signs, allows the signs to be rotatably adjusted around the pole to attain the optimum viewing orientation simultaneously from all directions, and also maintains the sign in a concentrically centered position relative to the axis of the pole. A sign holding mechanism is positioned at the top and bottom of the sign and is connected to a clamping mechanism, also at the top and bottom of the sign for securely mounting the device to a pole. The sign holding mechanism preferably comprises a ring or hoop and a plurality of brackets or clips which attach the signs to the ring. The clamping mechanism has means for adjustment to a wide variety of sizes and shapes of poles.

41 Claims, 5 Drawing Figures

MULTI-SIDED DISPLAY DEVICE

BACKGROUND AND SUMMARY OF THE INVENTION

The present invention relates to a multi-sided display device for displaying signs and posters of all kinds and more particularly to a display device having a unique means for holding the display materials and presenting them for optimum viewing on all sides.

There are numerous known sign stands and poster display devices which are used for displaying signs and messages for advertising and information to the public. These display devices are used in a number of different situations and mounted in a number of various ways. For example, sign display devices are typically seen in conjunction with service stations, business establishments and public transportation facilities, and are mounted on walls, poles, portable stands and the like. Difficulties have arisen, however, when the sign devices are located in a position permitting viewing from a number of directions, such as near a corner of intersecting roadways.

Also, when multi-sided signs and display devices are displayed on poles, the mounting devices are usually bulky and difficult to assemble and position. Further the signs themselves often are difficult to orient and adjust relative to the mounting device for proper presentation of the message to the public.

In situations where advertising or information materials are desired to be presented to pedestrian or vehicular traffic moving in one direction, a one-sided display device usually suffices. If the traffic pattern flows in passing parallel directions, two-sided display devices are in most cases sufficient. However, if an additional flow of passing traffic is introduced from a non-parallel direction, a multi-sided display device is usually necessary. As to the latter situation, the proper number of signs and the proper angle of sign face orientation are considerations which must be taken into account. Additional factors are the relative volume of traffic on each of the streets, the relative speeds of the traffic, and the presence of any poles, trees, etc. which might obstruct portions of the signs at various points and from various directions and distances.

Many known multi-sided devices are heavy and bulky, thus requiring specifically designed or strengthened supporting and hanging mechanisms, as well as additional space for installation. These multi-sided signs and display devices are difficult and time consuming to assemble in the first instance. They also are often difficult to adjust either circumferentially or vertically for proper orientation; sometimes it is necessary to take the entire device down and start over. Also, known multi-sided display devices are not easily adaptable to poles and stands of different sizes and cross-sectional shapes. In some cases, the orientation of the pole dictates the orientation of the multi-sided display device regardless of the viewing direction desired.

The present invention is an improvement over the aforementioned devices and overcomes the aforementioned disadvantages of known multi-sided sign and display devices. The present invention can be used with all types and sizes of posters, signs, advertising materials and panels. Also, it can be used either indoors or outdoors, along roads and at intersections, and on posts, poles, portable display stands and the like of all types. Specifically, the present invention can be used with the signs and message displaying devices such as disclosed in U.S. Pat. No. 4,138,787, issued Feb. 13, 1979. This patent relates to a message display holder with track members for securely gripping and holding differently-sized advertising panels.

It is an object of the present invention to provide a relatively uncomplex multi-sided display device which is relatively easy to assemble, install, and adjust (both circumferentially and vertically) to the best position for maximum viewing, is aesthetic and durable, presents an attractive advertising medium for viewing in any direction, and has a relatively inexpensive and uncomplex mounting mechanism with relatively few parts. Another object of the invention is to provide a multi-sided display device which can be circumferentially adjusted radially while in place to give optimum viewing angles from multiple directions. Still another object of the present invention is to provide a multi-sided display device adapted to handle a plurality of differently-sized and shaped advertising materials and panels and also be adjustable to poles and stands having different cross-sectional sizes and shapes, such as telescopic poles which present different sizes at different points.

The present invention is particularly useful for information and advertising dissemination-type applications where highway and/or walkway related signs are presented for view to passing and intersecting vehicular and/or pedestrian traffic. Often traffic patterns do not intersect at right angles. The present invention's ability to adjust the viewing angle of the various display sides while in place makes it very versatile; it consistently enables the optimum viewing angle to be obtained on all sides and if patterns change, to be easily adjusted to meet the new patterns of traffic.

In accordance with the invention, an adjustable multi-sided pole mounting sign display device is disclosed which has a pair of sign holding mechanisms and a pair of pole clamping mechanisms. The clamping mechanisms comprise a pair of brackets generally parallelly abutting opposing sides of the mounting pole and connected by a pair of rods. The sign holding mechanisms utilize a pair of tubular rings or hoops that are securely connected to the clamping mechanisms. The sign panels, etc. are individually connected at their top and bottom edges to the rings or hoops by mounting clips or hangers. The mounting clips are formed so that one end contacts and partially surrounds the hoop while the other end fastens onto the edge of the sign panel, thereby locking the two parts together in the specified plane as well as securely holding the two parts together. If desired, for both appearance and resistance to high wind loads, the sign panels themselves are connected to each other by the installation of end caps along their side edges.

Other objects, features, and advantages of the present invention will become apparent from a review of the following description and claims when taken in connection with the accompanying drawings.

DESCRIPTION OF THE PREFERRED EMBODIMENTS

Figure 1:
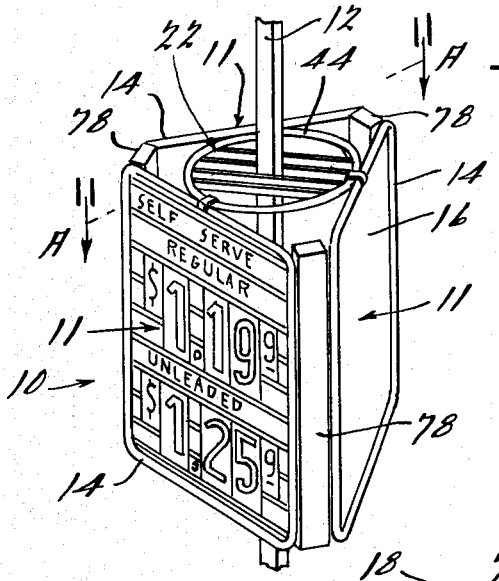
FIG. 1 illustrates a multi-sided sign display device being mounted on a pole in accordance with the present invention.
Figure 3:
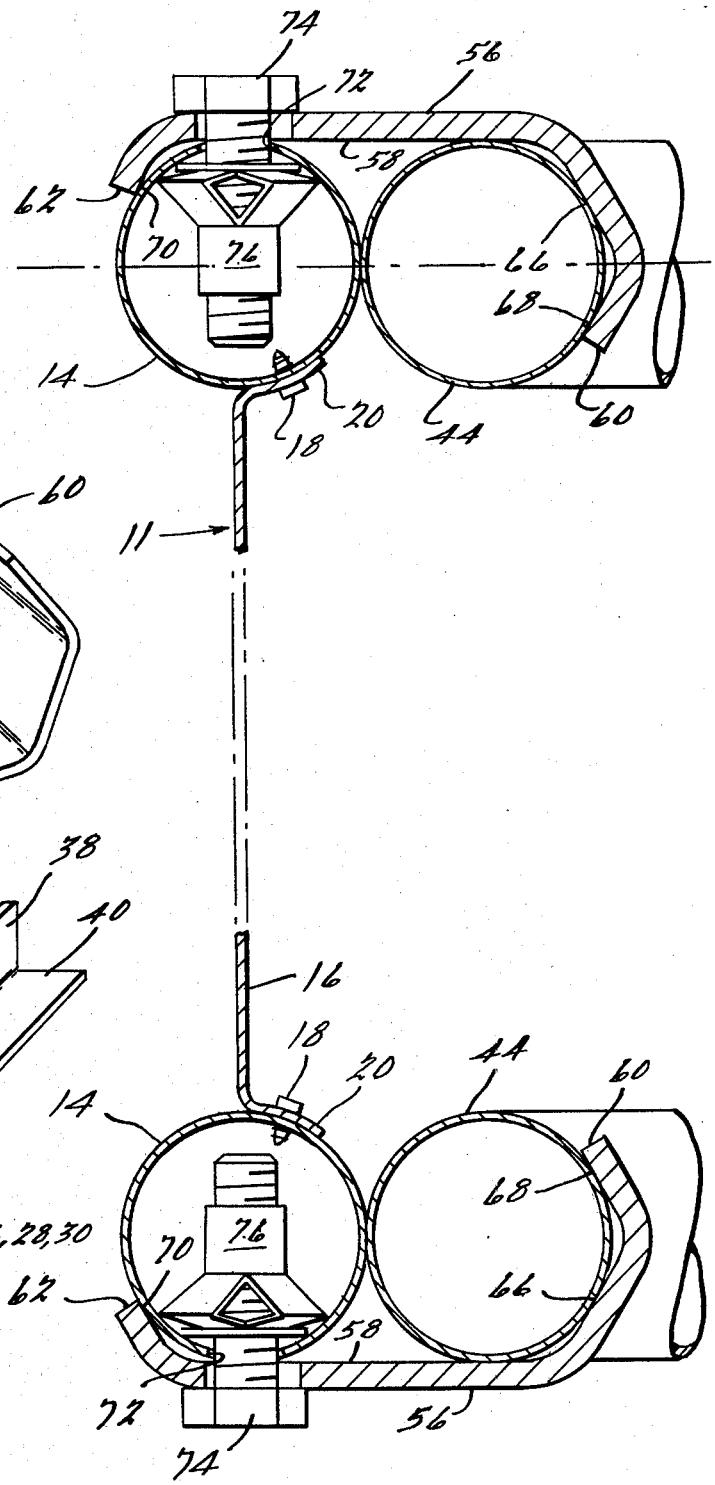
FIG. 3 is a cross-section taken along lines B—B in FIG. 2.

As shown in FIG. 1, the present invention is particularly related to a method and device for mounting a multi-sided sign display device 10 in a concentric manner on a pole 12 or similar structure. In the situation depicted, the invention is adapted for use at a gasoline or service station. The display device 10 has a plurality of individual signs 11, each of which in the embodiment shown comprise a tubular frame 14 extending around the perimeter of a backing panel 16. Since outdoor advertising signs are of a relatively large size, the frames 14 add strength and rigidity to the backing panels in particular and the signs in general. Frames 14 also make the sign more pleasing in appearance, and also allow it to be mounted more easily. As FIG. 3 shows, the frames 14 are made of a bent piece of tubing and are attached by screws 18 or other fastening means to the edges 30 of the backing panel 16. The edges 20 are bent around the perimeter of the panels 16 at an appropriate angle to provide a mounting surface for the tubing.

The backing panels 16 and frames 14 can be made of any type of material suitable for the intended use thereof, but are preferably made of coated steel or aluminum. The backing panels and frames should be made of a material which will not rust, discolor, or deteriorate during use and exposure to the elements. Hence, they preferably should be made of a material having durability, substantial long life, an ability to maintain integrity and quality throughout their life, and a pleasing appearance. The material for the frames 14 and backing panels 16 also should be formable so that the requisite bends can be formed relatively easily in them.

Also, as shown in FIG. 1, the sign display device 10 is preferably mounted vertically around a pole or similar support structure 12 with the signs 11 mounted to face a certain selected direction so they can be viewed simultaneously from all directions. The present invention will provide the same advantages and benefits regardless of the orientation or location of the sign.

Figure 2:
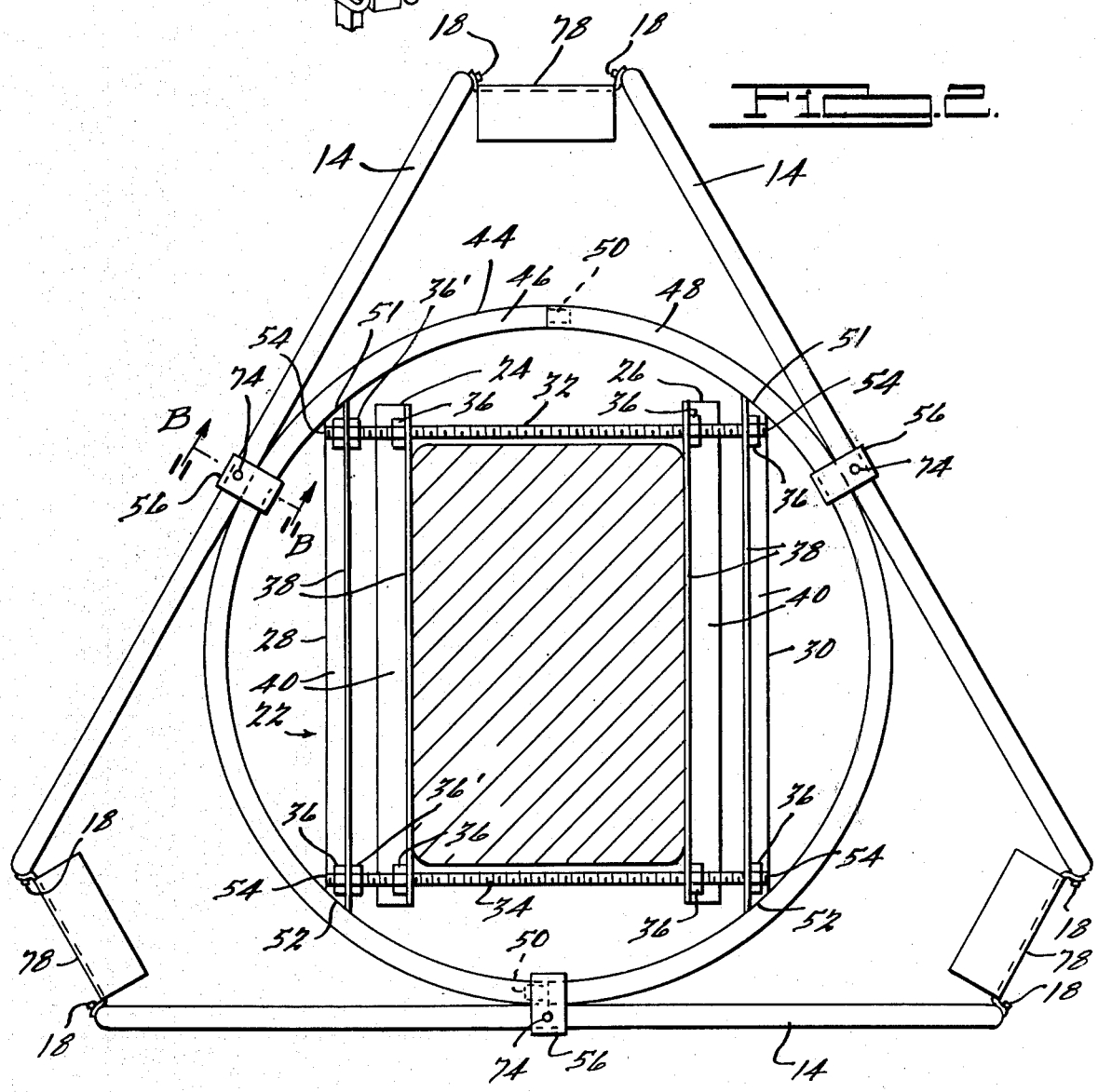
FIG. 2 is a cross-section and top view taken along lines A—A in FIG. 1.
Figure 5:
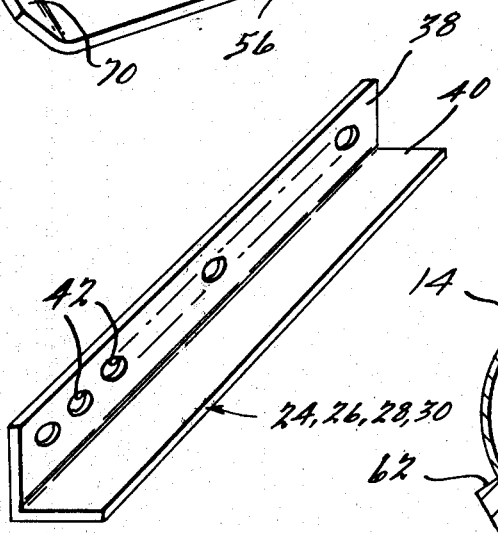
FIG. 5 is a perspective view of the brackets and support means depicted in FIGS. 1 and 2.

In accordance with the preferred embodiment of the invention and as shown in FIG. 2, the display device 10 is mounted to the pole 12 by a pair of clamping mechanisms 22. One of the clamping mechanisms is attached at the top of the multiple sign panels 11 and frames 14 and the other is attached at the bottom. Each of the clamping mechanisms 22 comprises a pair of brackets 24 and 26 and a pair of support means 28 and 30, a pair of rods 32 and 34 which may be threaded, and a plurality of locking means or nuts 36. The brackets 24 and 26 and support means 28 and 30, threaded rods 32 and 34 and nuts 36 also are made of metal although any other material with suitable properties and characteristics referred to above can be utilized. As depicted in FIG. 5, brackets 24 and 26 and support means 28 and 30 may be configured like angle irons. These angle irons 24, 26, 28 and 30 have upper portions 38 and side portions 40 and have a series of corresponding apertures or holes 42 in their upper portions 38. The series of holes 42 allows for immediate mounting on a wide variety of sizes and shapes of poles.

The clamping mechanisms 22 can be utilized with virtually any size or cross-sectional shape of pole or mounting structure 12. In this regard, the side portions 40 of brackets or angle irons 24 and 26 abut opposing sides of a mounting pole 12. In most cases, the pole or mounting structure will have a symmetrically shaped cross-section and thus the brackets 24 and 26 will be parallel to one another when mounted and secured in place. However, the unique clamping mechanisms of the present invention allow installation of the display device on poles or mounting structures with side surfaces which are $\pm 10°$ out of parallel.

The angle irons 24 and 26 lie in a plane perpendicular to the plane defined by the axis of the mounting pole. Angle irons 24 and 26 are drawn toward each other and thereby clamped to pole 12 by threaded rods 32 and 34 and nuts 36. The threaded rods 32 and 34 lie opposingly outward of pole 12 and perpendicular to angle irons 24 and 26. Each threaded rod protrudes through a pair of corresponding holes 42 in angle irons 24 and 26. Nuts 36 are threaded onto the protruding ends of each threaded rod to provide the clamping means exerted through the angle irons 24 and 26 upon the mounting pole 12.

For versatility, sign display device 10 is provided with hoop means comprising a pair of tubular rings or hoops 44 upon which the individual signs 11 are supported and around which the individual signs 11 can be adjusted to provide the optimum presentation viewing from any particular direction. Each hoop 44 comprises two half circle metal tubes 46 and 48 with inserts 50 that when assembled together form circular hoops 44. Half circles 46 and 48 have support means or angle irons 28 and 30 securely fastened to their interior circumference. Angle irons 28 and 30 each have two ends 51 and 52 that are securely fastened onto the interior circumference portion of half circles 46 and 48. In the preferred embodiment, ends 51 and 52 are welded equilaterally within and onto the interior circumference portion of half circles 46 and 48 such that when hoop 44 is formed, angle irons 28 and 30 are substantially parallel and lie in the same plane as hoop 44.

FIG. 2 shows that in conjunction with half circles 46 and 48 being assembled to form hoop 44, angle irons 28 and 30 are connected to the clamping mechanism 22 by engaging appropriate holes 42 in said angle irons with ends 54 of threaded rods 32 and 34 until ends 54 protrude to enable said angle irons to be secured onto threaded rods 32 and 34 by nuts 36. In order to securely hold the portions of the clamping mechanism in place during installation and thereafter, a second locking nut 36 is included on the opposite side of one or both of the outer angle irons 28 or 30. In this manner, hoops 44 will be anchored in a stationary and stable manner to pole 12 and in a fashion that is parallel with the ground, perpendicular to the pole's centerline axis, and concentric with the pole.

Figure 4:
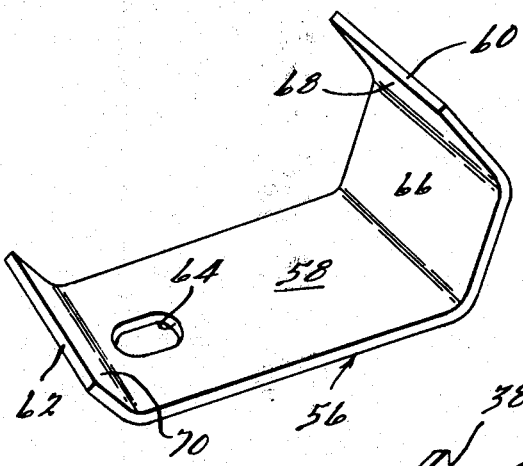
FIG. 4 is a perspective view of the mounting clip depicted in FIGS. 1–3.

As shown in FIGS. 2 and 3, the frames 14 of signs 11 are attached to hoops 44 by means of mounting brackets or clips 56. Each of the mounting clips 56 is defined by a substantially planar metal member 58 with ends 60 and 62 and a hole or slot 64, as shown in FIG. 4. End 60 is bent or curved in an upward manner to form a face 66 and then bent or curved further inwardly toward the opposite end of the clip to form a second face 68. End 62 is likewise bent or curved in an upward manner to form a face 70 that is similar to face 66, but not as long. The lengths of planar member 58 and faces 66, 68 and 70 are proportioned so that when the top or bottom of frame 14 is abutted with hoop 44 in the same plane, the mounting clip 56 abuts with hoop 44 in at least three points and abuts with frame 14 on at least two points. Hole 64 is positioned to correspond to a hole 72 in frame 14 such that the mounting clip is substantially rigidly fastened to frame 14 by means of a fastener or bolt 74 and a mounting stud 76 for receiving the end of bolt 74 from inside frame 14.

As shown in FIG. 3, the mounting clips 56 are further configured to retainably engage hoops 44 to frame 14 such that the two are pulled together in a specified plane and a substantially rigid connection is attained. Such a connection is effected because face 68 of mounting clip 56 is proportioned to engage hoop 44 beyond the horizontal centerline of hoop 44 and frame 14.

As depicted in FIGS. 1 and 2, display device 10 is made more rigid by utilization of end caps 78 to engage adjoining edges of signs 11. End caps 78 are substantially the same length as the frames 14 of the signs 11 and are of a width substantially equal to the space created between sides of frames 14 when the signs 11 are attached to hoops 44. Different sized end caps 78 can be used to accommodate signs of various sizes and shapes as well as display devices comprising different numbers of signs 11. End caps 78 can be fastened to the sides of frames 14 with threaded fasteners 18 much in the same way as the backing panels 16 are attached to frames 14, as explained above.

The signs 11 can be adjusted circumferentially along hoops 44 until backing panels 16 are oriented in the desired direction. This versatility in adjustment can be made by simply loosening the mounting clip bolts 74 and circumferentially sliding mounting clips 56, and hence frame 14, of sign 11 along hoops 44 until the desired viewing direction is reached at which point the mounting clip bolts 74 can again be properly tightened. For example, the signs 11 may be rotated to achieve a proper direction in facing toward the proper flow of traffic near an intersection or it may be rotated to avoid obstructions such as other signs, traffic lights, street lights, etc. from blocking its view.

The multi-sided sign display device 10 provides an improved method of installation over prior multi-sided sign display devices. The improved method is due in part to the unique and beneficial structure involved. The installation begins with assembling the angle irons 24 and 26 and threaded rods 32 and 34 around a mounting pole 12. This clamping mechanism 22 is then adjusted to a height corresponding with the desired top location of signs 11 and then secured by drawing angle irons 24 and 26 toward each other with nuts 36 threaded onto the protruding ends of the threaded rods 32 and 34. The half circle metal tubes 46 and 48 with attached angle irons 28 and 30 are then assembled around the pole 12 to form the hoop 44. Hoop 44 is attached to the clamping mechanisms described above by engaging the ends of threaded rods 32 and 34 with corresponding holes 42 in the angle irons 28 and 30 and securing the hoop with nuts 36. As shown in FIG. 3, locking nuts 36 may be utilized to hold one portion of the hoop 44 in place during installation and thereafter by including nut 36 on the opposite side of one or both of the outer angle irons 28 or 30.

The signs 11 are mounted to hoop 44 by butting the top of the tubular frame 14 of sign 11 to hoop 44 and then attaching a mounting clip 56 to the abutted tubular members and securing the assembly by fastening the clip 56 to the frame 14 by means of a bolt 74 and a mounting stud 76 for receiving the end of bolt 74 from inside the frame 14.

A second hoop 44 and clamping mechanism 22 is assembled and attached to the mounting pole 12 as described above at a height corresponding to the bottom of signs 11. The signs 11 are then secured at their bottom portions to the second hoop 44 with mounting clips 56 in a likewise manner. After the signs 11 are adjusted circumferentially along hoops 44 to achieve their desired orientation, end caps 78 are attached to the adjoining edges of signs 11 with fastening means 18 to complete the installation.

By providing the various portions of the clamping mechanism 22 with the series of holes, substantial flexibility in mounting of the device is achieved, and the installer is enabled to put up the sign quickly and easily and without utilizing any power tools. The adjustability of the parts also allows the sign to be mounted concentrically around poles of various shapes and sizes. Although the mounting clips 56 and bolts 74 and mounting studs 76 can be made of any material which is relatively rigid and can withstand adverse environmental conditions, they are preferably made of the same material as the clamping mechanism 22. Although the pole 12 shown in FIGS. 1 and 2 is rectangular in cross-section, it is understood that the invention can be used with poles of virtually any size, shape or diameter.

When the sign display device 10 is mounted on a pole, it is preferably mounted at the desired height and surrounds the pole 12 in a concentric manner relative to the pole's axis. This provides a sign mount which is more pleasing in appearance, and provides versatility in insuring equal visibility of the sign from all directions. It also means that any forces which are imposed on the sign during normal use, such as wind forces, will be uniformly distributed to the pole through the clamping and holding mechanisms and thus will prevent the sign from being twisted, distorted, or otherwise turned relative to the pole.

Although the above is the preferred embodiment of sign display device 10, another embodiment eliminates the substantially equally sized end caps 78. This would allow the individual frames to be custom oriented in particular directions so as to more efficiently utilize the sign. For instance, if a display device 10 were used at or near an intersection where the traffic patterns did not perpendicularly intersect, a 120° angle between each sign face or frame may not be most desirable. The end caps 78 could be made to fit to the specific angles desired or they could be left off altogether.

While it is apparent that the preferred embodiments illustrated herein are well calculated to fulfill the objects above stated, it will be appreciated that the present invention is susceptible to modification, variation and change without departing from the scope of the invention, as defined by the following claims.

What is claimed is:

1. A device for mounting a multi-sided sign display to a pole, said device comprising:

a pair of mounting means, each of said mounting means comprising hoop means and means for securely clamping said hoop means to said pole, said hoop means including a pair of tubular half circles with ends, said half circles each having an insert in one end, a plurality of sign panels, and means for fastening said sign panels to each of said hoop means, said fastening means being independent of said clamping means and said pole.

2. A device as set forth in claim 1 wherein said hoop means further comprises support means being securely fastened along the inside circumference of said half circle, said support means having a first portion situated in a plane perpendicular to a plane containing said half circle and having a plurality of apertures therein.

3. A device as set forth in claim 2 which said support means comprises an angle iron.

4. A device as set forth in claim 1 wherein said hoop means further comprises support means connected thereto and said pole clamping means comprises a pair of brackets, said brackets being securely fastened on said pole and said hoop means being securely fastened to said brackets.

5. A device as set forth in claim 1 wherein said means for fastening said sign panels to said hoop means comprises a plurality of mounting clips.

6. A device as set forth in claim 5 wherein said means for fastening said sign panels to said hoop means further comprises a bolt and a mounting stud.

7. A device as set forth in claim 5 wherein said mounting clips can be mounted loosely on said hoop means so that said sign panels can be moved and adjusted to their desired position.

8. A device as set forth in claim 5 wherein each of said mounting clips comprises a substantially planar member with a first end and a second end, said first end being bent upwardly to form a first face, and then bent inwardly toward the second end of said clip to form a second face, and said second end being bent upwardly to form a third face, said third face being shorter than said first face but similar in alignment thereto.

9. A device as set forth in claim 8 wherein said first, second and third faces are proportioned such that when said hoop means is abutted with the one end of each of said sign panels and said mounting clips are secured to said sign panels, said mounting clips hold said sign panels and hoop means together in abutting relationship.

10. A device as set forth in claim 5 wherein said mounting clips are configured to retainably engage said hoop means to said sign panels so as to pull them together and form a rigid connection.

11. A device as set forth in claim 1 wherein said sign panels comprises a tubular frame extending around the perimeter of a backing panel.

12. A device as set forth in claim 11 wherein said backing panel has a plurality of edges, said edges being bent around the perimeter of said backing panel at an appropriate angle to provide a mounting surface for said tubular frame.

13. A device as set forth in claim 1 further comprising end caps positioned between each of said sign panels.

14. A device as set forth in claim 13 wherein said end caps are substantially the same length as said sign panels and substantially equal to a width defined by the space between said sign panels when said sign panels are attached to said hoop means.

15. A device as set forth in claim 1 further including means for circumferentially adjusting said sign panels along said hoop means to provide optimum viewing orientation of said sign panels from all directions.

16. A device as set forth in claim 1 wherein said pair of mounting means, said sign panels, and said fastening means are made from non-corrosive material.

17. A device as set forth in claim 1 wherein one of said mounting means is attached to a top edge of said sign panels and the other of said mounting means is attached to a bottom edge of said sign panels.

18. A method for mounting a multi-sided sign display device to a pole, said display device comprising:

a pair of mounting means, each of said mounting means comprising hoop means and means for securely clamping said hoop means to said pole, a plurality of sign panels, and means for fastening said sign panels to each of said hoop means, the method of mounting comprising the steps of:

assembling one of said pole clamping means on said pole at the upper location for said sign panels, securing one of said hoop means to said pole clamping means, attaching the upper edges of said sign panels to said hoop means using said fastening means, assembling a second of said pole clamping means on said pole at the lower location for said sign panels, securing a second of said hoop means to said second pole clamping means, and attaching the lower edges of said sign panels to said second hoop means using said fastening means.

19. The method as set forth in claim 17 further comprising rotating said sign panels on said hoop means to provide optimum viewing orientation of said sign panels from all directions.

20. A method for mounting a multi-sided sign display device to a pole, said display device comprising:

pole clamping means comprising a pair of brackets with a plurality of first apertures in an upper portion, a pair of rods with ends and a plurality of locking means, hoop clamping means comprising a hoop, said hoop comprising a pair of tubular half circles each with support means with ends, said ends of said support means being securely fastened along the inside circumference of said half circle, said support means having a plurality of second apertures in an upper portion, a plurality of sign panels comprising tubular frames and backing panels, said frames being attached to the perimeter of said backing panels, and means for fastening said sign panels to said hoop, said fastening means comprising a mounting clip, a bolt, and a mounting stud, the method of mounting comprising the steps of:

assembling said brackets and said rods around a mounting pole such that said ends of said rods engage with and protrude from said first apertures of said brackets;

securing said brackets in a clamping fashion to said pole by attaching said locking means onto said protruding ends of said rods;

adjusting said pole clamping mechanism to a height corresponding with the desired location of the top of the sign panels and securing said pole clamping means to said pole at said height by tightening said locking means;

attaching additional locking means to a corresponding pair of said protruding ends of said rods;

assembling said tubular half circles with attached support means around said pole to form said hoop and attaching said hoop clamping means by engaging said ends of said rods with to said pole said second apertures in said support means such that said ends of said rods protrude from said second apertures;

securing said support means to said pole clamping means by attaching said locking means onto said protruding ends of said rods, said locking means bearing one of said support means against said additional locking means;

butting the tops of said frames of said sign panels against said hoop and attaching said mounting clip to said abutted frame and hoop and securing said clip by fastening said clip to said frame by means of said bolt and said mounting stud, assembling and attaching a second pole clamping means to said pole at a height corresponding to the bottom of said sign panels;

assembling and attaching a second hoop clamping means to said second pole clamping means, said second hoop clamping means comprising a second hoop;

securing said bottoms of said sign panels to said second hoop with said mounting clips, said bolts, and said mounting studs; and circumferentially adjusting said sign panels along said hoops to achieve a desired viewing orientation.

21. The method as set forth in claim 20 further comprising attaching a plurality of end caps to adjoining edges of said sign panels with suitable fastening means.

22. A device for mounting a multi-sided sign display to a pole, said device comprising:

a pair of mounting means, each of said mounting means comprising hoop means and means for securely clamping said hoop means to said pole, said hoop means including a pair of tubular half circles with ends, said half circles each having an insert in one end, a plurality of sign panels, and means for fastening said sign panels to each of said hoop means.

23. A device as set forth in claim 22 wherein said hoop means further comprises support means being securely fastened along the inside circumference of said half circle, said support means having a first portion situated in a plane perpendicular to a plane containing said half circle and having a plurality of apertures therein.

24. A device as set forth in claim 23 in which said support means comprises an angle iron.

25. A device for mounting a multi-sided sign display to a pole, said device comprising:

a pair of mounting means, each of said mounting means comprising hoop means and means for securely clamping said hoop means to said pole, said hoop means being positioned outwardly from said pole and being independent of said clamping means and said pole, a plurality of sign panels, and means for fastening said sign panels to each of said hoop means, said means for fastening said sign panels to said hoop means including a plurality of mounting clips adapted to be mounted loosely on said hoop means so that said sign panels can be moved and adjusted to their desired position.

26. A device for mounting a multi-sided sign display to a pole, said device comprising:

a pair of mounting means, each of said mounting means comprising hoop means and means for securely clamping said hoop means to said pole, a plurality of sign panels, and means for fastening said sign panels to each of said hoop means, said means for fastening said sign panels to said hoop means including a plurality of mounting clips, each of said mounting clips including a substantially planar member with a first end and a second end, said first end being bent upwardly to form a first face, and then bent inwardly toward the second end of said clip to form a second face, and said second end being bent upwardly to form a third face, said third face being shorter than said first face but similar in alignment thereto.

27. A device as set forth in claim 26 wherein said first, second and third faces are proportioned such that when said hoop means is abutted with the one end of each of said sign panels and said mounting clips are secured to said sign panels, said mounting clips hold said sign panels and hoop means together in abutting relationship.

28. A device for mounting a multi-sided sign display to a pole, said device comprising at least one hoop means, at least one clamping means for securing said hoop means to said pole, a plurality of sign panels, fastening means for attaching said sign panels to said hoop means, said fastening means comprising a plurality of mounting clips and being adapted to be selectively loosened for moving said sign panels circumferentially to a desired position on said hoop means, thereby selectively adjusting the orientation of said sign panels.

29. A device as set forth in claim 28, wherein said fastening means further comprises a bolt and a mounting stud.

30. A device as set forth in claim 28, wherein each of said mounting clips comprises a substantially planar member with a first end and a second end end, said first end being bent upwardly to form a first face, and then bent inwardly toward the second end of said clip to form a second face, and said second end being bent upwardly to form a third face, said third face being shorter than said first face but similar in alignment thereto.

31. A device as set forth in claim 30, wherein said first, second and third faces are proportioned such that when said hoop means is abutted with the one end of each of said sign panels and said mounting clips are secured to said sign panels, said mounting clips hold said sign panels and hoop means together in abutting relationship.

32. A device as set forth in claim 28, wherein each of said sign panels comprises a tubular frame extending around the perimeter of a backing panel.

33. A device as set forth in claim 32, wherein said backing panel has a plurality of edges, said edges being bent around the perimeter of said backing panel at an appropriate angle to provide a mounting surface for said tubular frame.

34. A device as set forth in claim 28, comprising a pair of said hoop means, one of said hoop means being attached to a top edge of said sign panels and the other of said mounting means being attached to a bottom edge of said sign panels.

35. A device for mounting a multi-sided sign display to a pole, said device comprising:

a pair of mounting means, each of said mounting means comprising hoop means and means for securely clamping said hoop means to said pole, said pole clamping means including a pair of brackets, a pair of rods, and locking means for securely holding said brackets to said rods and to said pole, said brackets each having a plurality of apertures for positioning of said rods therein, a plurality of sign panels, and means for fastening said sign panels to each of said hoop means, said fastening means being independent of said clamping means and said pole.

36. A device as set forth in claim 35 wherein said brackets comprise angle irons, said rods are threaded, and said locking means comprise nuts.

37. A device as set forth in claim 35 wherein said hoop means is assembled around said pole and securely fastened to said pole clamping means.

38. A device as set forth in claim 37 wherein said hoop means is fastened to said pole clamping means by means of interconnecting threaded rods and nuts.

39. A device as set forth in claim 4 further comprising additional locking nuts to insure a secure connection between said hoop means and said pole clamping means.

40. A device for mounting a multi-sided sign display to a pole, said device comprising:

a pair of mounting means, each of said mounting means comprising hoop means and means for securely clamping said hoop means to said pole, said hoop means including a pair of tubular half circles with ends, said half circles having means at one end to connect together to form said hoop means, a plurality of sign panels, and means for fastening said sign panels to each of said hoop means, said fastening means being independent of said clamping means and said pole.

41. A device as set forth in claim 40 wherein said means to connect said half circles together comprises an insert in one end of each of said half circles.

* * * * *

UNITED STATES PATENT AND TRADEMARK OFFICE

CERTIFICATE OF CORRECTION

PATENT NO. : 4,347,678

DATED : September 7, 1982

INVENTOR(S) : John K. Laakso

It is certified that error appears in the above-identified patent and that said Letters Patent are hereby corrected as shown below:

Col. 8, Line 64: add --to said pole-- prior to "clamping means"

Col. 8, Line 65: delete "to said pole"

Signed and Sealed this

*Fifth* Day of *July 1983*

[SEAL]

*Attest:*

GERALD J. MOSSINGHOFF

*Attesting Officer*

*Commissioner of Patents and Trademarks*